US007768539B2

(12) United States Patent
Chen

(10) Patent No.: US 7,768,539 B2
(45) Date of Patent: Aug. 3, 2010

(54) METHOD AND SYSTEM FOR COLOR CORRECTION FOR A DISPLAY TERMINAL

(75) Inventor: ZengQiang Chen, Shenzhen (CN)

(73) Assignee: BYD Company Limited, Shenzhen (CN)

( * ) Notice: Subject to any disclaimer, the term of this patent is extended or adjusted under 35 U.S.C. 154(b) by 894 days.

(21) Appl. No.: 11/644,559

(22) Filed: Dec. 21, 2006

(65) Prior Publication Data

US 2007/0139448 A1 Jun. 21, 2007

(30) Foreign Application Priority Data

Dec. 21, 2005 (CN) ..... 2005 1 0022409

(51) Int. Cl.
*G09G 5/10* (2006.01)

(52) U.S. Cl. ..... 345/690; 345/204; 345/88

(58) Field of Classification Search ..... 345/87–90, 345/204, 690–693
See application file for complete search history.

(56) References Cited

U.S. PATENT DOCUMENTS 6,388,648 B1 * 5/2002 Clifton et al. ..... 345/88
6,924,796 B1 * 8/2005 Someya et al. ..... 345/213
7,136,035 B2 * 11/2006 Yoshida ..... 345/87
7,336,272 B2 * 2/2008 Okamoto ..... 345/211
7,474,303 B2 * 1/2009 Shin et al. ..... 345/204
7,502,038 B2 * 3/2009 Yasuda et al. ..... 345/690
2002/0126106 A1 * 9/2002 Naito ..... 345/204
2004/0046720 A1 * 3/2004 Nagai et al. ..... 345/82
2004/0189626 A1 * 9/2004 Mori ..... 345/204
2005/0200578 A1 * 9/2005 Lee et al. ..... 345/82
2006/0007089 A1 * 1/2006 Lee et al. ..... 345/88
2006/0208983 A1 * 9/2006 Lee et al. ..... 345/89

* cited by examiner

*Primary Examiner*—Nitin Patel
(74) *Attorney, Agent, or Firm*—Venture Pacific Law, PC

(57) ABSTRACT

A method and system relating to color correction for the display terminal of a display device, such method includes a master control unit generating color adjusting ratios, a display driver using the color adjusting ratios to perform color calibration, and a display panel displaying the resulting colors. Specifically, the master control unit generates adjusting ratios for the RGB color data and the display driver separately adjusts each color according to the percentage of R, G, and B in the ratio to generate a resulting pixel voltage. The system consists of a master control unit, a display driver, and a display panel. The master control unit contains an initialization block, having the following special characteristics: a master control unit with a color adjusting module that receives the color adjusting ratio sent from a color setting block, adjusts color data according to the adjusting ratio, generates the resulting pixel voltage, and displays the colors via a display panel. This invention is easy to operate, inexpensive to produce, and highly practicable.

15 Claims, 8 Drawing Sheets

METHOD AND SYSTEM FOR COLOR CORRECTION FOR A DISPLAY TERMINAL

CROSS REFERENCE

This application claims priority from a Chinese patent application entitled "A Method and System for Color Correction for a Display Terminal" filed on Dec. 21, 2005, having a Chinese Application No. 200510022409.4. This Chinese application is incorporated here by reference.

FIELD OF INVENTION

This invention relates to display devices, and, in particular, to a color correction method and system for a display terminals.

BACKGROUND OF INVENTION

Currently, color planar display technologies such as LCD, OLED, etc. all treat color pictures as if they are a pixel array made up of limited pixels. The display panel of LCD and OLED is a pixel array made up of pixels which are independent of one another. At the same time, each pixel consists of three adjacent, relatively independent red, green, and blue pixels. When the three primary colors of red, green, and blue differ in value, the pixels will display different colors.

The existing display terminal is comprised of three major components, a master control unit, a display driver, and a display panel. Upon powering up, the master control unit completes the initialization of all driver circuits; then the master control unit forwards all display data that it has received to the display driver, which processes the display data, outputs the corresponding voltage, and lights up the corresponding pixels in the display panel. While processing the display data, e.g., performing gamma adjustment, for many display panels, the relationship between the driving voltage/electric current coming from the display driver and the grayscale of display on the display panel is nonlinear. Through gamma adjustment, the linear display of RGB data is converted to a nonlinear display of RGB data on the display panel so that the display panel can correctly display the grades of the linear display data.

Generally speaking, each special display panel has only one corresponding gamma correction value which is provided by the manufacturer. Once the display panel and the display driver are assembled into a display module, the gamma correction value in the display driver will not change.

When manufacturing display panels, the display quality of different batches or different display panels in the same batch may differ due to the different production techniques. When these display panels are made into different display terminals, the display results of these display terminals may be completely different even though the identical display data source is used. Some display terminals look more reddish, some appear more bluish, and so on. To solve this problem, the current technology can only resort to raising the manufacturing standard of the display terminals as much as possible while minimizing the variation in production technique, which, to a great extent, increases the product cost of the display terminals.

Therefore, it is desirable to have an easy-to-operate, low-cost color correction system and methods to solve the problem of display inconsistency.

SUMMARY OF INVENTION

This purpose of this invention is to provide an easy-to-operate, low-cost color correction method and system for display terminals in order to solve the problem of display inconsistency on the display terminals when using the prior art technologies.

This invention utilizes a color correction method and system wherein the master control unit generates a color adjusting ratio. The display driver according to the said color adjusting ratio performs color adjustment, and the display panel displays the resulting color.

This color correction method and system for the display terminal may comprised of the following steps:

A. The master control unit generates an adjusting ratio for the RGB color data and forwards it to the display driver;

B. The display driver, according to the R, G, and B content in the adjusting ratio, performs separate adjustments and generates the responsive pixel voltage; and C. The display panel displays the resulting color.

Said step A may comprised of the following steps:

A1. The master control unit receives the YCbCr color correction value;

A2. The master control unit, according to the adjusting ratio, calculates the R, G, and B in the corresponding RGB color data and generates an adjusting ratio for each of them; and A3. The master control unit sends the adjusting ratio to the display driver.

In said step A1, the YCbCr color correction value can be forwarded to the master control unit via a respective external input device.

In said step B, the display driver also performs gamma correction on the R, G, and B components and may comprised of the following steps:

B1. The display driver stores in memory the R, G, and B components from the adjusting ratio value that it has received;

B2. The display driver, at the minimum, adjusts the R, G, and B components respectively, according to the adjusting ratio that is stored in the memory; and B3. Generates the respective pixel voltages.

Said step B2may comprised of the following steps:

B21. The display driver receives the R. G, and B components in the second adjusting ratio sent by the master control unit; and B22. The display driver combines the second adjusting ratio and the adjusting ratio that is stored in the memory, and adjusts the R, G, and B components independently according to the combined ratio.

This color correction system for the display terminal may comprised of a master control unit, a display driver, and a display panel. The master control unit may comprised of an initialization block which initializes the system. The master control unit then forwards data information to the display driver.

DESCRIPTION OF THE DRAWING

The foregoing and other objects, aspects and advantages of the invention will be better understood from the following detailed description of the preferred embodiments of this invention when taken in conjunction with the accompanying drawings in which.

DETAILED DESCRIPTION OF THE PREFERRED EMBODIMENTS

Figure 1:
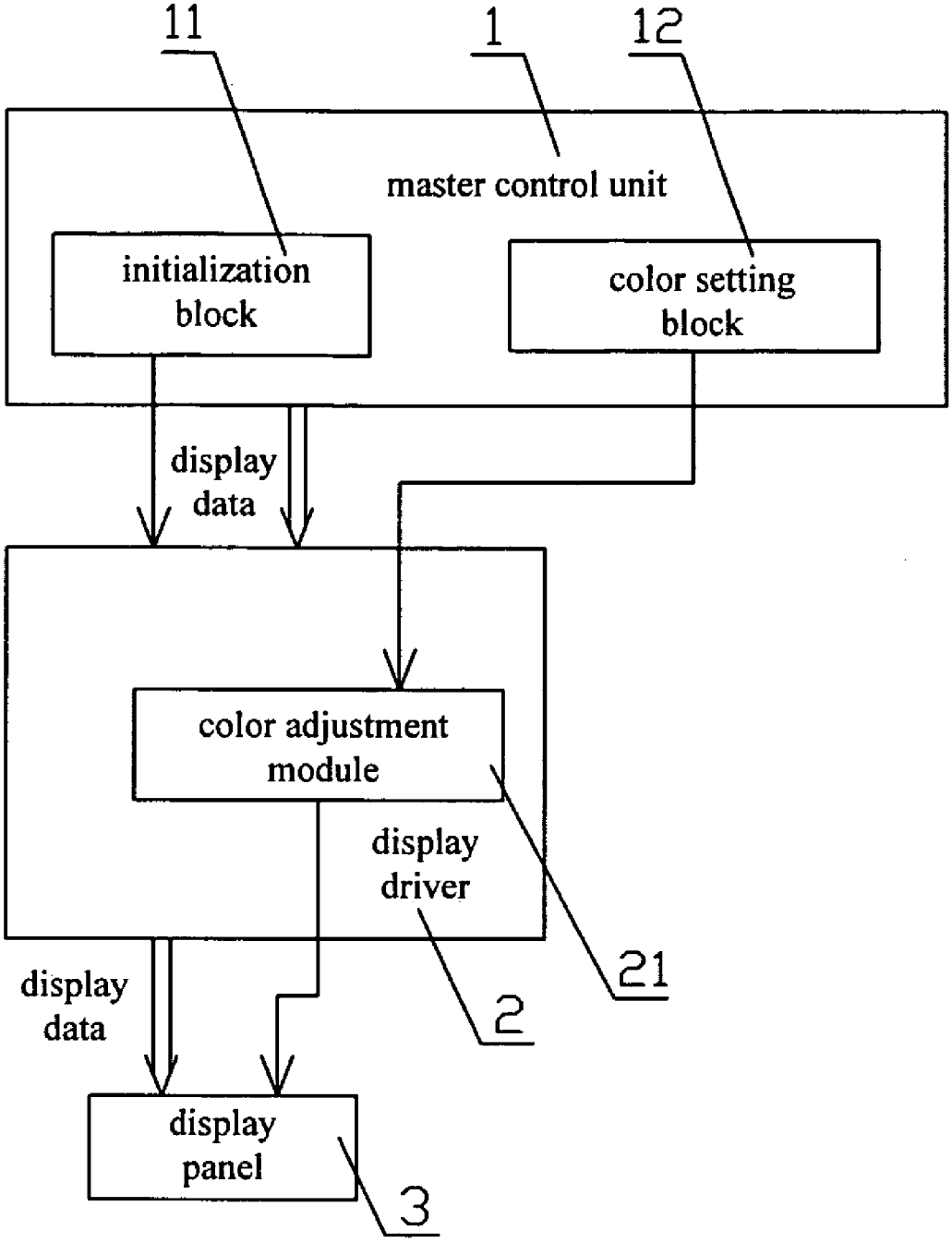
FIG. 1 is a block diagram for the overall structure of embodiment 1 of this invention.

The presently preferred embodiment of this invention utilizes a color correction method and system wherein the master control unit generates a color adjusting ratio. The display driver according to the said color adjusting ratio performs color adjustment, and the display panel displays the resulting color.

This color correction method and system for the display terminal may comprise of the following steps:

B. The master control unit generates an adjusting ratio for the RGB color data and forwards it to the display driver;

C. The display driver, according to the R, G, and B content in the adjusting ratio, performs separate adjustments and generates the responsive pixel voltage; and D. The display panel displays the resulting color.

Said step A is comprised of the following steps:

A1. The master control unit receives the YCbCr color correction value;

A2. The master control unit, according to the adjusting ratio, calculates the R, G, and B in the corresponding RGB color data and generates an adjusting ratio for each of them; and A3. The master control unit sends the adjusting ratio to the display driver.

In said step A1, the YCbCr color correction value can be forwarded to the master control unit via a respective external input device.

In said step B, the display driver also performs gamma correction on the R, G, and B components.

Said step B is comprised of the following steps:

B1. The display driver stores in memory the R, G, and B components from the adjusting ratio value that it has received;

B2. The display driver, at the minimum, adjusts the R, G, and B components respectively, according to the adjusting ratio that is stored in the memory; and B3. Generates the respective pixel voltages.

Said step B2 is comprised of the following steps:

B21. The display driver receives the R. G, and B components in the second adjusting ratio sent by the master control unit; and B22. The display driver combines the second adjusting ratio and the adjusting ratio that is stored in the memory, and adjusts the R, G, and B components independently according to the combined ratio.

This color correction system for the display terminal is comprised of a master control unit, a display driver, and a display panel. The master control unit is comprised of an initialization block which initializes the system. The master control unit forwards data information to the display driver. The master control unit further may comprise of a color setting block which derives the color adjusting ratio value.

Said display driver may comprise of a color adjusting module which receives the color adjusting ratio sent by the color setting block, performs the color correction according to said adjusting ratio, generates respective pixel voltages, and displays the color via the display panel.

The color adjusting module may comprise of an adjustment module for R components, an adjustment module for G components, and an adjustment module for B components. The color setting block derives an adjusting ratio for R, G, and B components respectively and forwards them separately to the adjustment module for R components, the adjustment module for G components, and the adjustment module for B components.

The display driver further includes memory which stores adjusting ratios for R, G, and B components. Said color adjustment module performs respective adjustments according to the adjusting ratios stored in the memory.

The color setting block may comprise of an interface sub module for adjusting data and a calculating sub module, wherein said interface sub module for adjusting data receives YCbCr color correction values and forwards them to the calculating sub module. The said calculating sub module, according to the existing RGB color data and the YCbCr color adjusting ratios, performs RGB color data calculation to calculate the R, G, and B components in the adjusting ratio and forwards the results of the calculation to the color adjustment module.

The color setting block further may comprise of a corrected data input module which forwards the YCbCr color correction value to the interface sub module for adjusting data.

The display driver may further comprise of a gamma adjustment module which performs gamma correction for the color data.

The benefits of this invention are that in this invention the master control unit generates the color adjusting ratio, the display driver performs color correction according to the said color adjusting ratio; and the display panel displays the respective colors. It is the equivalent of using the master control unit to make the display driver pre-adjust the colors. This pre-adjustment can simply compensate for the variation in display caused by the differences in the display panels. For instance, in this invention, the master control unit generates an adjusting ratio for the RGB color data and forwards it to the display driver. The display driver, according to the R, G, and B components (i.e., the red, green, and blue components), performs adjustments for the red, green, and blue components respectively, generates the pixel voltages for these three colors, and displays the respective colors on the display panel. The colors displayed are corrected colors. In comparison with existing technologies, this method is simple and easy to implement, achieves display consistency in the display terminal, reduces requirements for the display panel, and keeps the production cost relatively low.

In the embodiments of this invention, setup using the YCbCr color adjusting ratio makes YCbCr color coding more straightforward, namely simply specifying the brightness component Y, the bluish color component Cb, and the reddish color component Cr. The ease of operation further enhances the practicality of this invention.

In the embodiments of this invention, the display driver stores in memory the R, G, and B components of the adjusting ratio and, according to the adjusting ratio stored in the memory, performs independent adjustments of the R, G, and B components to generate the respective pixel voltage. In fact, this method can achieve the relative stability in color pre-correction as mentioned in this invention. For the production of display terminals, such stability can ensure consistency in product quality (display consistency), thus making this invention widely applicable and enhancing its practicality.

At the same time, the displayed RGB data adjustment of this invention is done by the adjustment module (hardware) of the display driver, greatly reducing the time that would otherwise be used by the master control unit for display. For example, for a display module with a pixel array of 132×132, the master control unit will have to send 132×132=17424 display data to the display driver for each picture that is displayed. If the data correction is done by the master control unit (assuming that the master control unit will consume two processing cycles for processing a single data), then for the time it takes the master control unit to adjust each picture, the RGB data equals to 17424×2=34848 processing cycles; whereas it takes the master control unit a fraction of the time prior to the display to set up the adjusting ratio in the adjustment module when data is adjusted via the display driver. Storing the adjusting ratio in non-volatile memory also saves the setup time.

In the embodiments of this invention, the display driver also receives the second adjusting ratio for the R, G, and B components forwarded by the master control unit. For instance, by setting the data for the master control unit using the respective external input devices or the adjustment data input module in the color setting block, coupled with the adjusting ratio stored in the memory, this second adjusting ratio can provide custom setup for the user, making this invention more customizable and further enhances the applicability of this invention.

The following sample embodiments provide a further detailed description of this invention:

Embodiment 1

Figure 2:
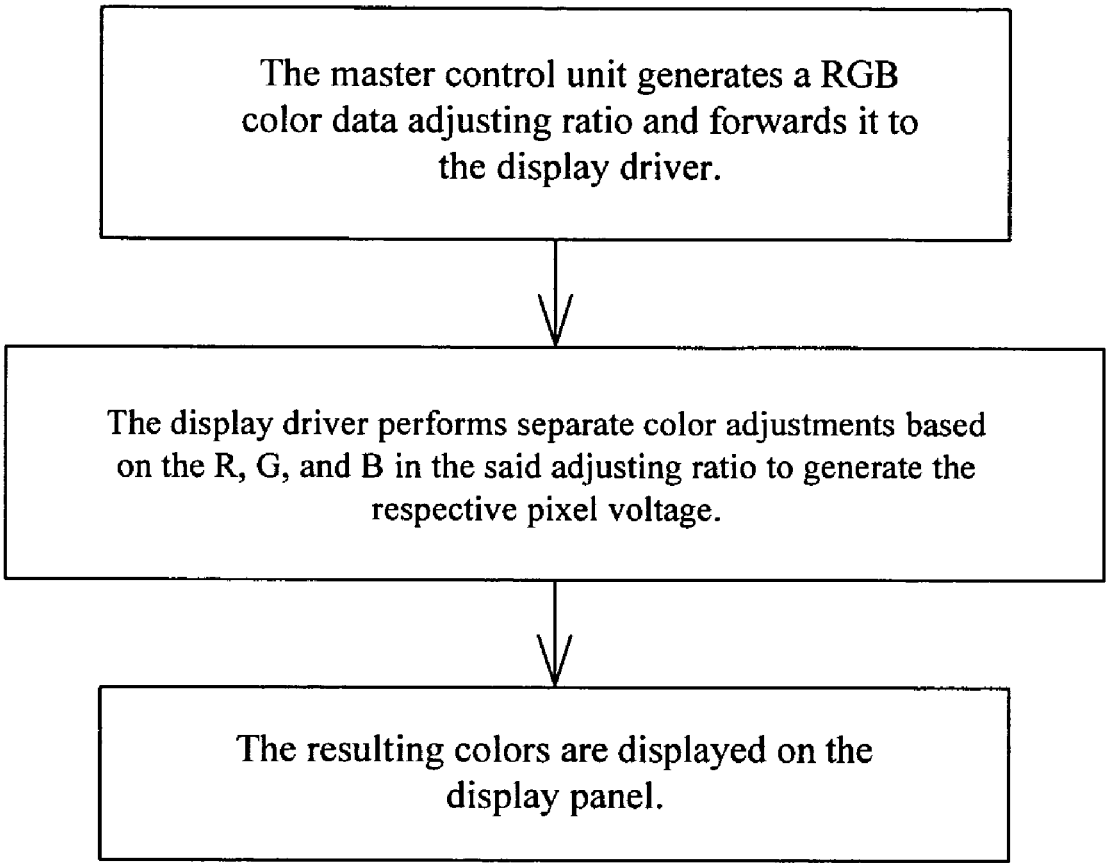
FIG. 2 is a flowchart illustrating the basic control flow for embodiment 1 of this invention.

According to FIGS. 1 and 2, this invention includes a master control unit 1, a display driver 2, and a display panel 3. The master control unit 1 is comprised of an initialization block 11 and a color setting block 12, wherein the initialization block 11 initializes the system. The master control unit 1 forwards display data to display driver 2. The color setting block 12 generates a color adjusting ratio and forwards it to the display driver 2.

According to FIG. 1, the display driver 2 is comprised of a color adjustment module 21, which receives the color adjusting ratio generated by the color setting block 12, performs color correction according to the adjusting ratio, generates the respective pixel voltages, and displays the respective colors via the display panel 3.

As illustrated in FIG. 2, the basic control flow for this embodiment is as follows:

1) The color setting block 12 in the master control unit 1 generates an adjusting ratio for the RGB color data and forwards it to the color adjustment module 21 in the display driver 2;

2) The color adjustment module 21, according to the R, G, and B components in the adjusting ratio, performs separate adjustments, generates the respective red, green, and blue pixel voltages, and passes it on to the display panel 3; and 3) The display panel 3 displays the respective colors.

In this method, the master control unit 1 generates the color adjusting ratio. The display driver 2, according to the adjusting ratio, performs color correction and the display panel 3 displays the respective colors.

Embodiment 2

Figure 3:
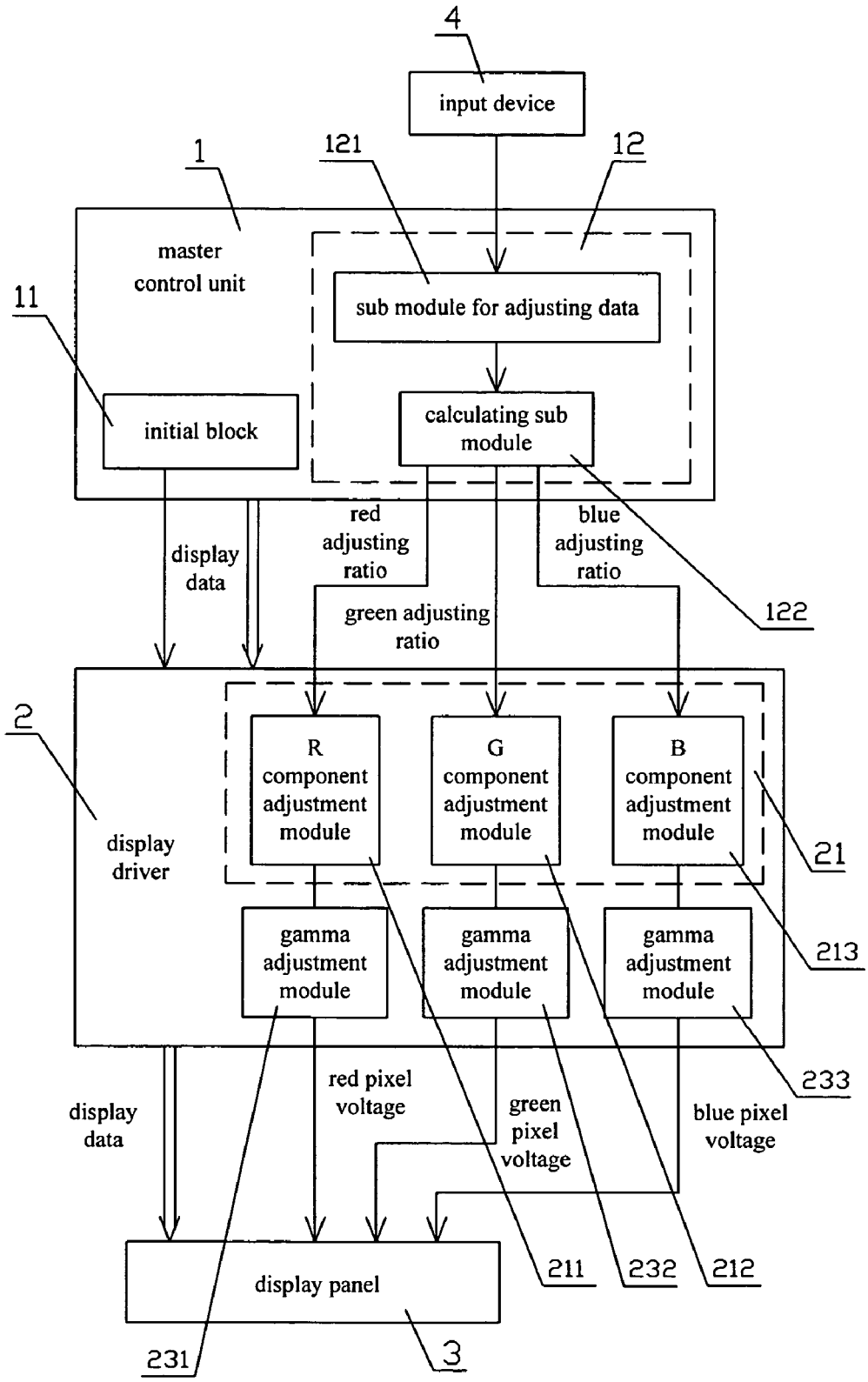
FIG. 3 is a diagram illustrating the structure for embodiment 2 of this invention.
Figure 4:
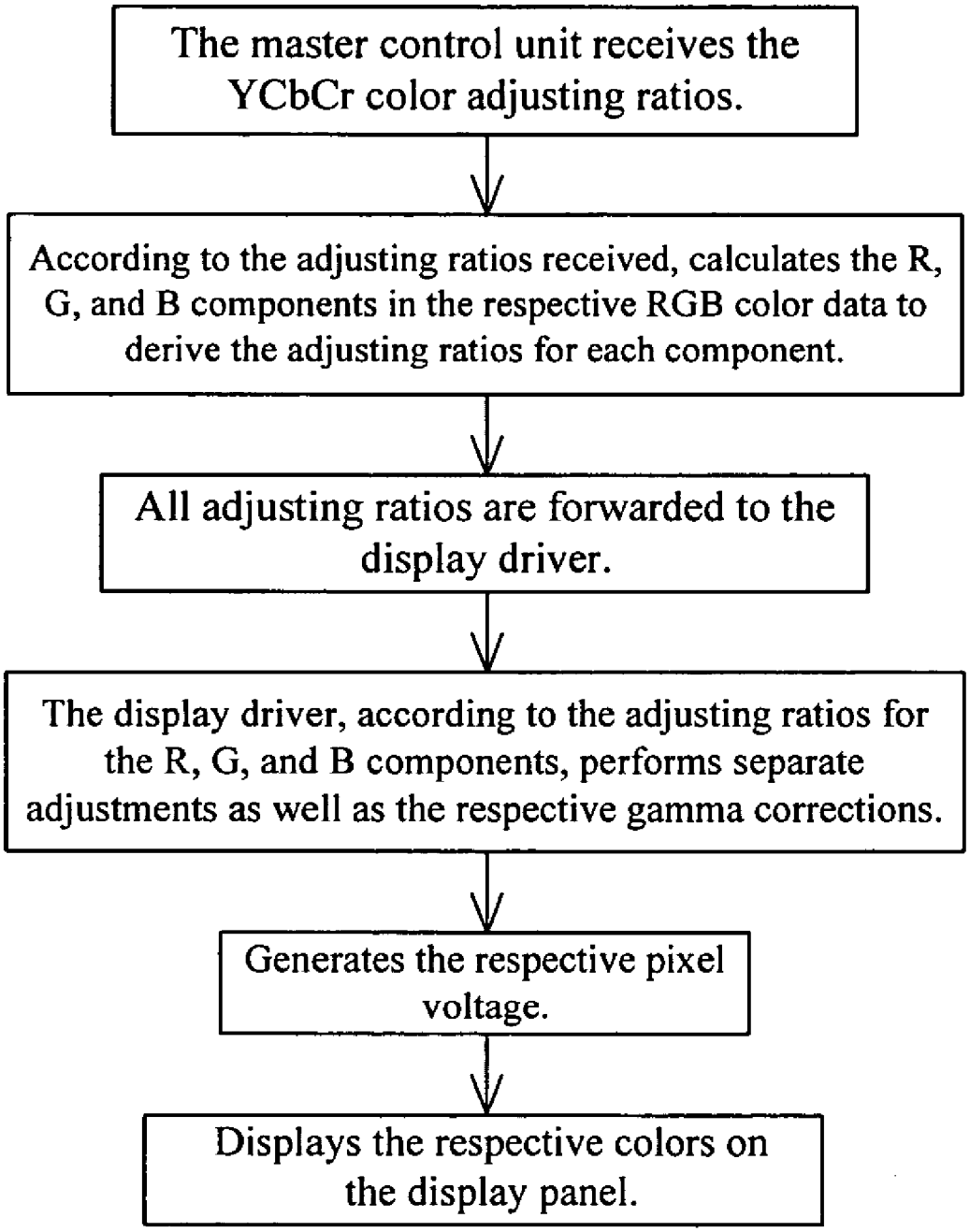
FIG. 4 is a block diagram illustrating a detailed control flow for embodiment 2 of this invention.

According to FIGS. 3 and 4, this invention is comprised of a master control unit 1, a display driver 2, and a display panel 3. The master control unit 1 is comprised of an initial block 11 and a color setting block 12. The initial block 11 initializes the system. The master control unit 1 forwards display data to the display driver 2. The color setting block 12 generates a color adjusting ratio and forwards it to the display driver 2.

Specifically, as illustrated in FIG. 3, the color setting block 12 is comprised of an interface sub module for adjusting data 121 and a calculating sub module 122, wherein the interface sub module for adjusting data 121 receives the YCbCr color correction value and forwards it to the calculating sub module 122. The interface sub module for adjusting data 121 receives the setting data from the respective external input device 4.

As illustrated in FIG. 3, the calculating sub module 122, according to the existing RGB color data and the YCbCr color correction value, performs RGB color data conversion to calculate the R, G, and B components in the adjusting ratio and forwards the results of the calculation to the color adjustment module 21. The conversion between the RGB color data and the YCbCr color data is performed as follows:

In the YCbCr color space, wherein the "Y" represents brightness, "Cr" represents the red components in the color spectrum of the light source. "Cb" represents the blue components in the color spectrum of the light source. When increasing the intensity of brightness of the picture, the value of Y is increased while keeping the values of Cb and Cr unchanged. When decreasing color temperature, the values Cb/Cr is decreased and the value of Cr is increased to increase the red color component while keeping the value of Y unchanged. However, because the display panel displays the RGB color space, the YCbCr values must be converted to RGB values. According to the BT-160 standard, the conversion between the YCbCr color space and the RGB color space uses the following formulas:

$$Y=(77R+150G+29B)/256 \text{ Range: } 16_235$$

$$Cb=(-44R-87G+131B)/256+128 \text{ Range: } 16_240$$

$$Cr=(131R-110G-21B)/256+128 \text{ Range: } 16_240$$

$$\text{Thus: } R=Y+1.371(Cr-128)$$

$$G=Y-0.698(Cr-128)-0.336(Cb-128)$$

$$B=Y+1.732(Cb-128)$$

According to the aforementioned formulas, the calculating sub module 122 converts the correction of color temperature/brightness that the corrected data interface 121 has received to the RGB adjusting ratio, and forwards it to the color adjustment module 21.

As illustrated in FIG. 3, the display driver 2 is comprised of the color adjustment module 21, wherein the color adjustment module 21 receives the color adjusting ratio sent out by the color adjustment module 12, performs color data adjustment according to the adjusting ratio, generates the respective pixel voltages and displays the respective colors via the display panel 3. The color adjustment module 21 is comprised of an R component adjustment module 211, a G component adjustment module 212, and a B component adjustment module 213. The adjusting ratios for the R, G, and B components generated by the calculating sub module 122 are forwarded to the R component adjustment module 211, the G component adjustment module 212, and the B component adjustment module 213, respectively. As illustrated in FIG. 3, the display driver also is comprised of the respective gamma adjustment modules 231, 232, and 23. The gamma adjustment modules 231, 232, and 233 perform gamma correction on the R, G, and B color data.

As illustrated in FIG. 4, the specific control flow of this embodiment is as follows:

a) The interface sub module for adjusting data 121 in the master control unit 1 receives the YCbCr color correction value sent by the input device 4 and forwards it to the calculating sub module 122;

b) The calculating sub module 122, according to the correction that it has received, calculates the R, G, and B components in the respective RGB color data to derive the adjusting ratios for each component;

c) The calculating sub module 122 forwards the adjusting ratios for the R, G, and B components to the respective R component adjustment module 211, the G component adjustment module 212, and the B component adjustment module 213 within the display driver 2;

d) The R component adjustment module 211, the G component adjustment module 212, and the B component adjustment module 213 perform separate adjustments, according to the R, G, and B components in the adjusting ratio and also perform respective gamma corrections via the gamma adjustment modules 231, 232, and 233;

e) Generates the respective red, green, and blue pixel voltages and passes it on to the display panel 3; and f) Displays the respective colors on the display panel 3.

Embodiment 3

Figure 5:
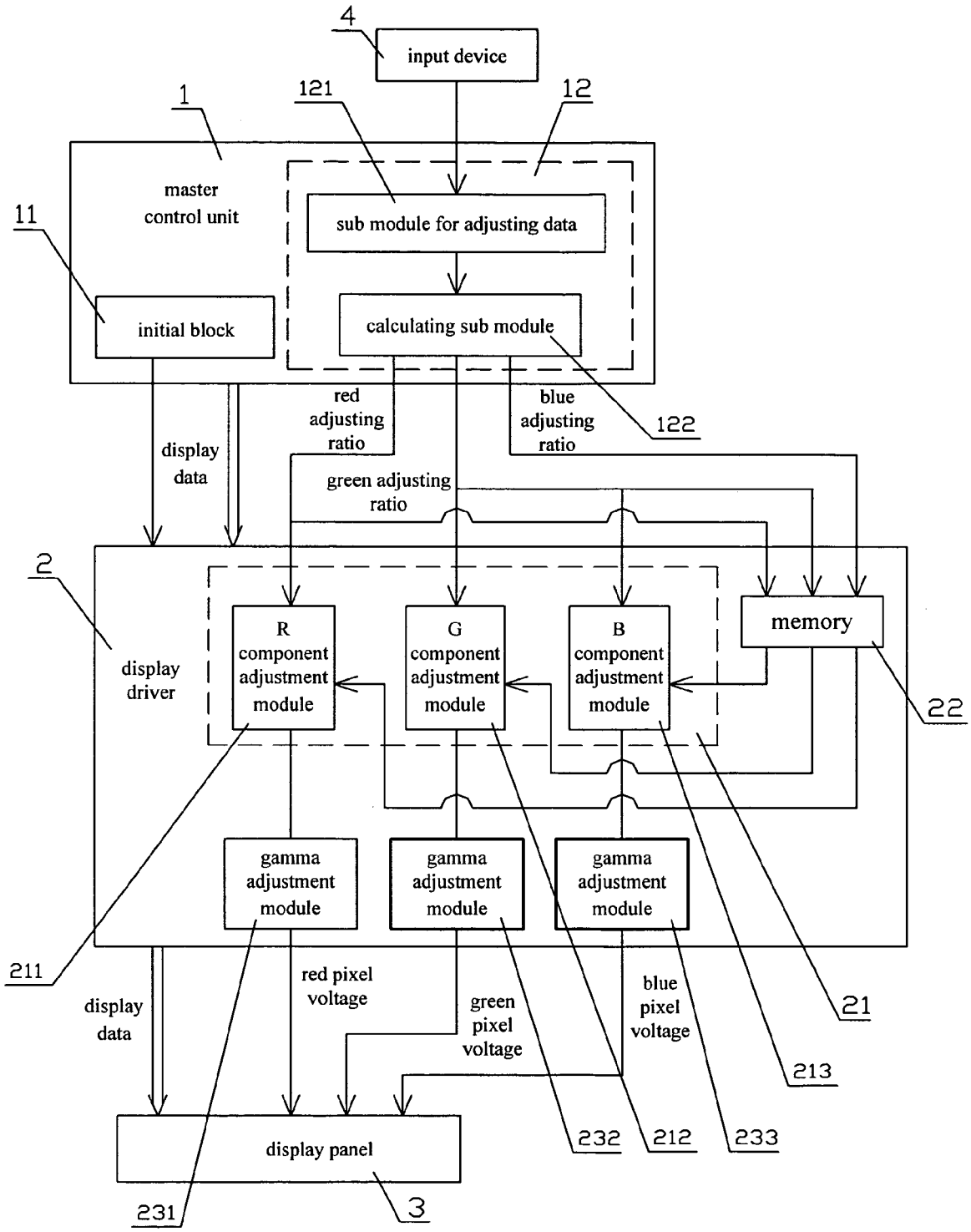
FIG. 5 is a diagram illustrating the overall structure of embodiment 3 of this invention.
Figure 6:
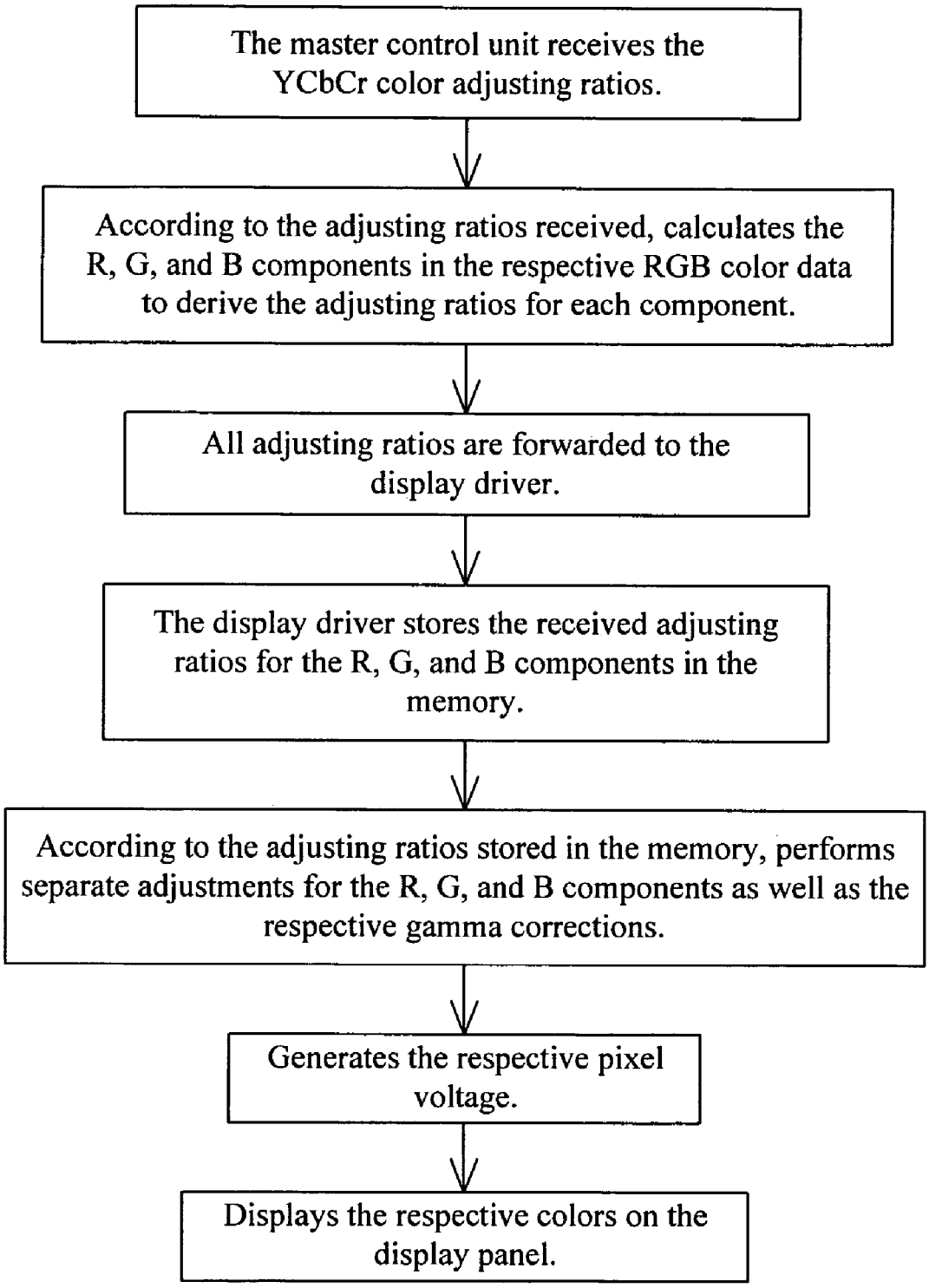
FIG. 6 is a flowchart illustrating the detailed control flow for embodiment 3 of this invention.

According to FIGS. 5 and 6, this embodiment differs from embodiment 2 in that the display driver 2 in this embodiment is further comprised of a memory 22. The memory 22 retains the R, G, and B components of the adjusting ratio. The color adjustment module 21, according to the adjusting ratio retained in the memory 22, performs respective adjustments.

As illustrated in FIG. 6, the specific control flow for this embodiment is as follows:

I. The interface sub module for adjusting data 121 in the master control unit 1 receives the YCbCr color correction value sent forwarded by the input device 4 and passes it on to the calculating sub module 122;

II. The calculating sub module 122, according to the correction value that it has received, calculates the R, G, and B components in the respective RGB data and generates the adjusting ratio for each component;

III. The calculating sub module 122, forwards the adjusting ratios for the R, G, and B components to non-volatile memory 22 in the display driver 2;

IV. The memory 22, stores the received adjusting ratios for the R, G, and B components;

V. The R component adjustment module 211, the G component adjustment module 212, and the B component adjustment module 213, according to the adjusting ratios for the R, G, and B components, perform respective adjustments, and conduct gamma correction via the respective gamma correction module 231, 232, and 233;

VI. The respective red, green, and blue pixel voltage is generated and is passed on to the display panel 3; and VII. The display panel 3 displays the respective colors.

In this embodiment, the memory 22, functions in such a way that, in the embodiment of this invention, though the input device 4 may not load the correction value at the next power-on, the adjusting ratio for the R, G, and B components that are stored in memory 22 still functions. This adjustment provides relative stability.

Embodiment 4

Figure 7:
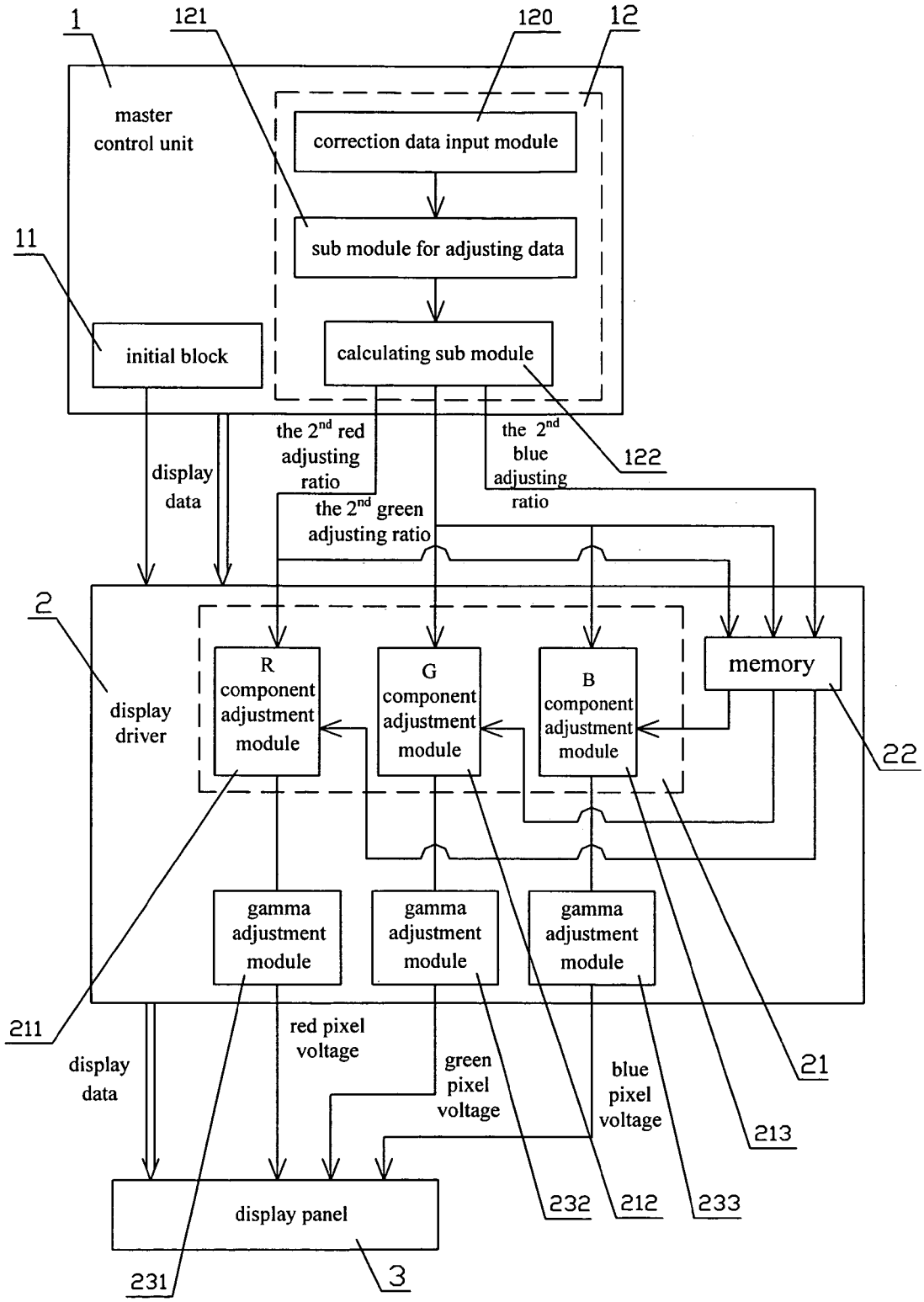
FIG. 7 is a block diagram illustrating the overall structure of embodiment 4 of this invention.
Figure 8:
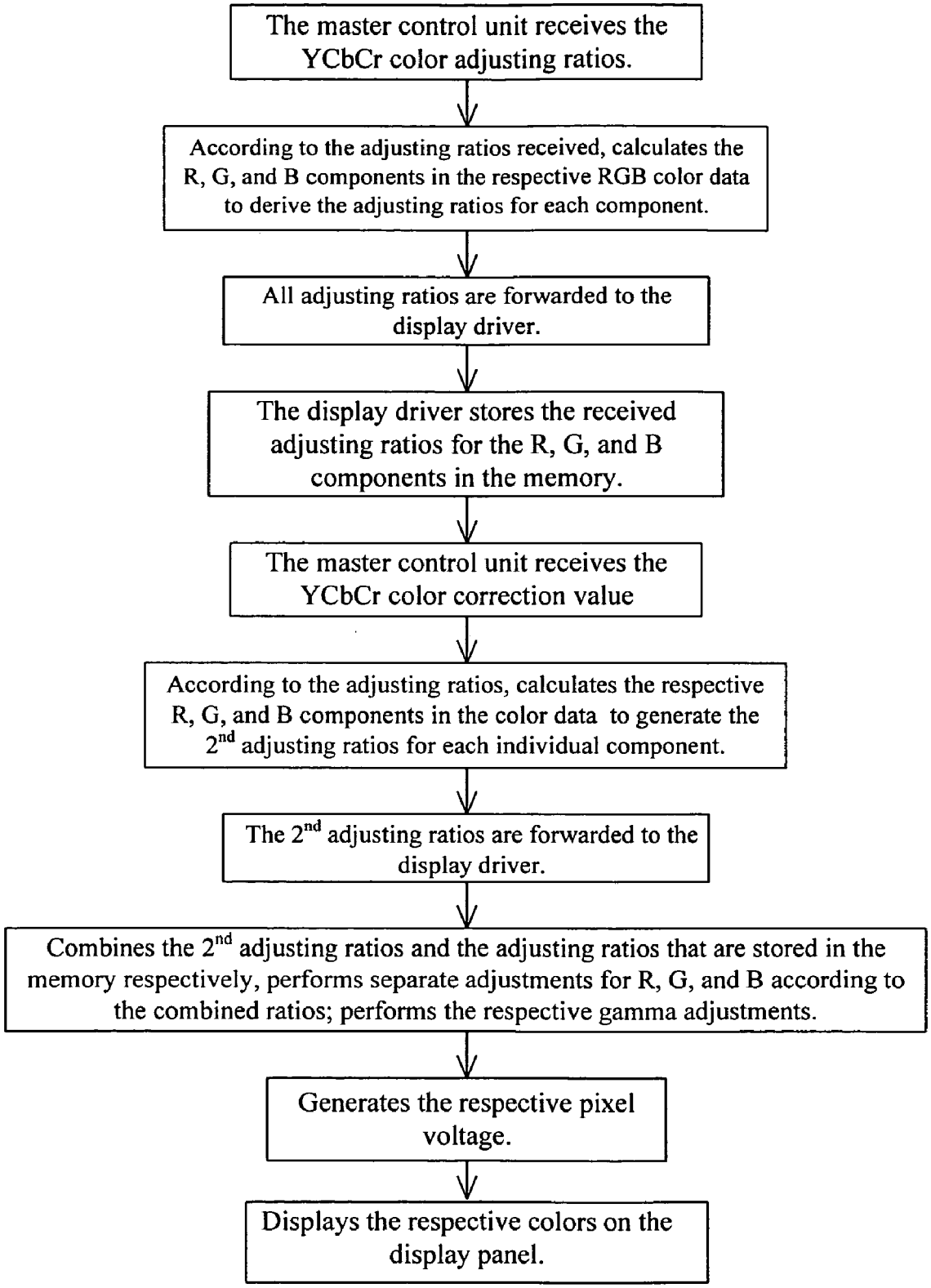
FIG. 8 is a flowchart illustrating the detailed control of embodiment 4 of this invention.

According to FIGS. 7 and 8, the main difference between this embodiment and embodiment 3 is that the color setting block 12, as in this embodiment is further comprised of a correction data input module 120. The correction data input module 120 forwards the YCbCr color correction values to the interface sub module for adjusting data 121.

As illustrated in FIG. 8, the specific control flow of this embodiment is as follows:

The interface sub module for adjusting data 121 receives the YCbCr color correction values and forwards them to the calculating sub module 122;

The calculating sub module 122, according to the received correction values, calculates the R, G, and B components of the respective color data to generate the initial correction values for each component;

The calculating sub module 122 forwards the initial adjusting ratios of the R, G, and B components to the EEPROM 22 on the display driver 2;

The memory 22, stores the initial adjusting ratios of the R, G, and B components that were received;

The interface sub module for adjusting data 121 receives the YCbCr color correction values that are forwarded by the correction data input module 120 and passes them on to the calculating sub module 122;

The calculating sub module 122, according to the received correction values, calculates the respective R, G, and B components of the RGB color data to generate the second adjusting ratios for each component;

The calculating sub module 122 forwards the second adjusting ratios to the R component adjustment module 211, the G component adjustment module 212, and the B component adjustment module 213;

The R component adjustment module 211, the G component adjustment module 212, and the B component adjustment module 213 combine separately the R, C, and B components in the second adjusting ratios and the initial adjusting ratios that are stored in the memory 22. They then perform separate adjustments for each of the combined values and make the respective gamma corrections;

The respective the red, green, and blue pixel voltages that are generated are passed on to the display panel 3; and The respective colors are displayed on the display panel 3.

In this embodiment, the interface sub module for adjusting data 121 of step 1 can receive data via an external input device 4 and can also receive data from the correction data input module 120. Steps 1 through 4 represent the relative fixed setting for color adjustment, namely, the manufacturers in using this invention to provide uniformity (in the products); whereas the correction values of step 5 represent personal setting of the specific users (customers). More applications can be made using this invention, which can be implemented by technicians in this field without making any creative effort. No further elaboration is warranted here.

While the present invention has been described with reference to certain preferred embodiments, it is to be understood that the present invention is not limited to such specific embodiments. Rather, it is the inventor's contention that the invention be understood and construed in its broadest meaning as reflected by the following claims. Thus, these claims are to be understood as incorporating not only the preferred embodiments described herein but also all those other and further alterations and modifications as would be apparent to those of ordinary skilled in the art.

I claim:

1. A method for color correction for a display terminal, having a master control unit generating a color adjusting ratio, a display driver performing color adjustment according to said color adjusting ratio, and a display panel displaying the adjusted colors, comprising the steps of:

generating color adjusting ratios by said master control unit for RGB color data and forwarding the color adjusting ratios to the display driver;

adjusting by said display driver, in accordance with the color adjusting ratios, separate adjustments to RGB components and generating respective digital pixel voltages; and displaying on the display panel in accordance with generated digital pixel voltages.

2. The method of claim 1, wherein the generating step further includes the following steps:

the master control unit receiving an YCbCr color correction value;

the master control unit, according to the correction value, calculating the RGB percentage contained in the RBG color data and generating color adjusting ratios for each RGB component; and the master control unit forwarding the generated color adjusting ratios to the display driver.

3. The method of claim 2 wherein the YCbCr color correction value is sent to the master control unit via a corresponding external input device.

4. The method of claim 1 wherein the display driver also performing gamma adjustment to the RGB components.

5. The method of claim 2, further including the following steps:

the display driver storing the received RGB color adjusting ratios in memory;

the display driver, at least according to the color adjusting ratios stored in memory, performing separate adjustments for the RGB components; and generating the respective pixel voltages.

6. The method of claim 5, further comprising the steps of:

the display driver receiving one or more second adjusting ratios for the RGB components from the master control unit; and the display driver separately adding the second adjusting ratios and the color adjusting ratios stored in the memory, and adjusting the RGB components accordingly.

7. A color correction system for display terminals, comprising:

a master control unit having an initialization block for performing system initialization and a color setting block for generating color adjusting ratios;

a display driver having a color adjustment module for receiving the color adjusting ratios from the color setting block, and adjusting color data according to the color adjusting ratios, and generating the respective pixel voltages; and a display panel for displaying adjusted color data in accordance with the respective pixel voltages.

8. The system of claim 7, wherein:

the color adjustment module having for RGB components a R adjusting sub module, a G adjusting sub module, and a B adjusting sub module; and the color setting block generating adjusting ratios value for the RGB components and forwarding them separately to the R adjusting sub module, the G adjusting sub module, and the B adjusting module.

9. The system of claim 8 wherein the display driver having a memory unit, wherein the memory unit contains the adjusting ratios for the RGB components, and the color adjustment module performing the corresponding adjustments according to the adjusting ratios in the memory unit.

10. The system of claim 7 wherein the said color setting block having a correction data input module and a calculating sub module, wherein;

the correction data input module receives one or more YCbCr color correction values and forwards the YCbCr color correction values to the calculating sub module; and the calculating sub module, according to RGB color data and the YCbCr color correction values, converts the color data, computes the adjusting ratios for the RGB components, and sends the converted color data and the adjusting ratios to the color adjusting module.

11. The system of claim 8 wherein the said color setting block having a correction data input module and a calculating sub module, wherein;

the correction data input module receives one or more YCbCr color correction values and forwards the YCbCr color correction values to the calculating sub module;

the calculating sub module, according to RGB color data and the YCbCr color correction values, converts the color data, computes the adjusting ratios for the RGB components, and sends the converted color data and the adjusting ratios to the color adjusting module.

12. The system of claim 7 wherein the display driver further comprising of a Gamma adjustment module for performing Gamma adjustments on the color data.

13. The system of claim 8 wherein the display driver further comprising of a Gamma adjustment module for performing Gamma adjustments on the color data.

14. The system of claim 10 wherein the display driver further comprising of a Gamma adjustment module for performing Gamma adjustments on the color data.

15. The system of claim 11 wherein the display driver further comprising of a Gamma adjustment module for performing Gamma adjustments on the color data.

* * * * *